US007108617B2

(12) United States Patent
Gorski et al.

(10) Patent No.: US 7,108,617 B2
(45) Date of Patent: Sep. 19, 2006

(54) RACKET FOR BALL GAMES

(75) Inventors: Peter Gorski, Koblach (AT); Herfried Lammer, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 97 days.

(21) Appl. No.: 10/785,416

(22) Filed: Feb. 25, 2004

(65) Prior Publication Data

US 2004/0224799 A1 Nov. 11, 2004

(30) Foreign Application Priority Data

Feb. 27, 2003 (DE) ..... 103 08 533

(51) Int. Cl.
*A63B 49/00* (2006.01)

(52) U.S. Cl. ..... 473/521; 473/520; 473/549; 473/523

(58) Field of Classification Search ..... 473/520–524, 473/549
See application file for complete search history.

(56) References Cited

U.S. PATENT DOCUMENTS

| | | | | |
|---|---|---|---|---|
| 5,071,125 | A * | 12/1991 | Shen | 473/521 |
| 5,172,911 | A * | 12/1992 | Chang | 473/521 |
| 5,178,387 | A | 1/1993 | Kuebler | |
| 5,242,724 | A * | 9/1993 | You | 473/521 |
| 5,314,180 | A * | 5/1994 | Yamagishi et al. | 473/521 |
| 5,599,019 | A * | 2/1997 | Davis et al. | 473/549 |
| 5,860,878 | A * | 1/1999 | You | 473/549 |
| 6,254,501 | B1 * | 7/2001 | Chang | 473/545 |
| 6,471,607 | B1 * | 10/2002 | Hsu | 473/523 |
| 6,663,515 | B1 * | 12/2003 | Pai | 473/521 |
| 6,685,583 | B1 * | 2/2004 | Severa et al. | 473/549 |
| 2004/0224799 | A1 * | 11/2004 | Gorski et al. | 473/520 |
| 2005/0003911 | A1 * | 1/2005 | Yu | 473/521 |
| 2005/0009649 | A1 * | 1/2005 | Okamoto | 473/521 |

FOREIGN PATENT DOCUMENTS

| | | |
|---|---|---|
| DE | 42 00 596 A1 | 2/1993 |
| DE | 692 06 967 T2 | 8/1996 |
| DE | 690 25 588 T3 | 9/2001 |
| DE | 202 09 723 U1 | 1/2003 |

OTHER PUBLICATIONS

Masanori, T., "Racket Frame", Patent Abstracts of Japan of Japanese Publication No. 01181881 A, Jul. 19, 1989.
Yasuhiro, S., "Racket Frame", Patent Abstracts of Japan of Japanese Publication No. 01207084 A, Aug. 21, 1989.

* cited by examiner

*Primary Examiner*—Raleigh W. Chiu
(74) *Attorney, Agent, or Firm*—Finnegan, Henderson, Farabow, Garrett & Dunner LLP

(57) ABSTRACT

The present invention relates to a racket, in particular a tennis racket or squash racket having a particularly suitable dampening behavior. For this purpose, the ball game racket of the present invention comprises a racket head, a heart region and a handle portion which together form a frame, wherein in the region of the handle portion and/or in the region of the transition between handle portion and heart region a dampening means consisting of a front and/or a rear dampening element is arranged.

18 Claims, 11 Drawing Sheets

Handle without dampening
acceleration (filtered)[m/s2]
75
50
25
0
-25
-50
-75
0
0.1
0.2
0.3
0.4
0.5
0.6
0.7
0.8
0.9
1.0
time[s]

dampening ratio, calculated on the basis of a filtered signal
free vibration
natural frequency 155.6 Hz
amplitude 16.04
delta=3.10
dampening ratio=0.0032
A-ln(delta)
4
3.5
3
2.5
2
0
0.1
0.2
0.3
0.4
0.5
0.6
0.7
0.8
time[s]

Ampl_Peak
15
12.5
10
7.5
5
2.5
0
0
20
40
60
80
100
120
140
160
180
200
frequency[Hz]

Fork with dampening
acceleration (filtered)[m/s2]
75
50
25
0
-25
-50
-75
0
0.1
0.2
0.3
0.4
0.5
0.6
0.7
0.8
0.9
1.0
time[s]

dampening ratio, calculated on the basis of a filtered signal
free vibration
natural frequency 156.9 Hz
amplitude 15.60
delta=3.05
dampening ratio=0.0031
A-ln(delta)
4
3.5
3
2.5
2
0
0.1
0.2
0.3
0.4
0.5
0.6
0.7
0.8
time[s]

Ampl_Peak
15
12.5
10
7.5
5
2.5
0
0
20
40
60
80
100
120
140
160
180
200
frequency[Hz]

Fork without dampening
acceleration (filtered) [m/s2]
75
50
25
0
-25
-50
-75
0
0.1
0.2
0.3
0.4
0.5
0.6
0.7
0.8
0.9
1.0
time[s]

dampening ratio, calculated on the basis of a filtered signal
free vibration
natural frequency 155.6 Hz
amplitude 20.62
delta=3.03
dampening ratio=0.0031
A-ln(delta)
4.5
4
3.5
3
2.5
0
0.1
0.2
0.3
0.4
0.5
0.6
0.7
0.8
time[s]

Ampl_Peak
20
15
10
5
0
0
20
40
60
80
100
120
140
160
180
200
frequency[Hz]

RACKET FOR BALL GAMES

The present invention relates to a racket for ball games, in particular a tennis racket, squash racket, racquet ball racket or a badminton racket, comprising a frame, a head region for receiving a stringing and a handle or grip portion. Rackets of this kind can furthermore comprise a heart region or a fork between the head region and the handle portion.

When striking a ball, the racket is first deflected by the ball. After the ball has deflected the racket, it flies away from the bent or deflected racket. After separation from the ball, the racket begins to vibrate in its free dampened vibration (natural or characteristic frequency).

When striking a ball, the force acting on the stringing is in general lead via the stringing into the frame of the head region and, from there, via the adjoining heart region into the grip portion, where it is received by the player. Such forces or shocks or vibrations are, at least when acting for a long time, i.a. responsible for possible health problems of the player, such as for instance the so-called tennis elbow.

Furthermore, a continuous compensation of the impact shock and the forces occurring during the game make the player quickly tired. Moreover, the control of the racket and thus the playability characteristics are influenced by too strong forces acting on the player.

DE-A-42 00 596 describes a racket for ball games, in particular a tennis racket, comprising a stringing in a stringing frame consisting of a profiled or sectional bar, an adjoining heart region as well as a handle on a racket shaft on the longitudinal axis of the racket which preferably forms a straight line of symmetry, in which the free end of the handle is defined by a handle end face having a hinge location whose hinge axis extends more or less parallel to the stringing and which is formed in the region of the handle by two extremely narrow grooves which are more or less in alignment with each other on both sides of an intermediate web and whose groove walls have a small distance from each other, for instance between 0.5 and 0.2 mm, preferably approximately 1.0 mm.

U.S. Pat. No. 5,178,387 describes a racket for ball games, in particular a tennis racket, comprising a stringing in a stringing frame, wherein a heart region adjoins the stringing frame and wherein the frame comprises a handle on the longitudinal axis of the racket. Between the heart region and the end of the handle there is a hinge location, wherein the hinge axis extends parallel to the stringing. The hinge zone is preferably disposed in the handle and is formed by a contraction or necking of the handle which is preferably defined on both sides by groove-like channels and is filled with an elastic shaped mass.

JP-A-01 181 881 discloses a racket frame comprising a grip or handle portion having a cylindrical handle outer shell body made of a hard material, e.g., light metal, wherein a highly viscous elastic element is provided in a cavity between the handle outer shell body and the frame.

JP-A-01 207 084 describes a racket frame having a projecting grip or handle cap in the grip portion of the frame. The racket frame comprises a mechanism for forming a projecting grip cap section which is integrated continuously in a grip portion. The grip portion of the frame is inserted in a grip part in a rotation-proof manner, and the grip portion of the frame and the projecting grip cap section are integrally formed.

However, the rackets known from the state of the art do not achieve an optimum dampening, so that when the ball is not struck with the center, the so-called striking shock or impact shock, which occurs upon contact with the ball, is only dampened or reduced insufficiently. Thus, during the game the player is exposed to high forces or pulse forces; this, on the one hand, increases the stress acting on the player considerably and, on the other hand, allows the occurrence of health problems such as the so-called tennis elbow. Moreover, the dampening of the racket and the frequency of the entire system of racket/stringing has a substantial influence on the guiding behavior of the racket as well as on the subjective playability feeling of the player. The state of the art is furthermore disadvantageous in that by contractions or neckings in the cross-sectional area of the frame potential weak points are created which could allow damage to the racket under the influence of high forces. Moreover, the rackets known from the state of the art do not fulfill the possibility of an optimum, simple and/or quick and cost-saving production.

It is the object of the present invention to provide an improved racket, in particular an improved tennis racket or an improved squash racket. Further and/or additional objects of the present invention reside in the provision of a racket which overcomes the disadvantages of the state of the art, exhibits an improved dampening behavior, can be produced in a simple and cost-saving manner and/or exhibits improved playability characteristics. This/these object(s) is/are achieved with the features of the claims.

The invention starts out from the basic idea of providing a dampening means in the handle portion of a ball game racket, which comprises at least one rear dampening element extending at least partially along the longitudinal axis of the handle portion and/or at least one front dampening element on the end of the handle portion facing the head region of the ball game racket and/or on the transition between handle portion and heart region of the racket. The rear dampening element, which is arranged along the handle portion, is preferably provided in the form of a sheet material along the handle surfaces extending parallel to the stringing. The front dampening element is preferably arranged on the end of the handle portion facing the head region or heart region of the ball game racket on the surfaces extending substantially parallel to the stringing, wherein it is preferably adapted to the contour of the frame of the ball game racket in this region.

In a further preferred embodiment of the present invention, one or both dampening element(s) is/are arranged so as to partly or completely surround the circumference of the handle portion of the ball game racket.

In accordance with the present invention, the frame of the ball game racket comprises a multi-layer structure in the handle portion, wherein the rear dampening element of the dampening means, which is realized as a sheet material, forms at least one layer of the multi-layer structure. In a preferred embodiment of the present invention, the sheet material has a length of at least about 150 mm, e.g., 150 to 200 mm, preferably about 180 mm, and a width of at least 10 mm, e.g., 10 to 18 mm, preferably about 14 mm, and is, as already mentioned above, arranged on the surfaces of the handle portion extending substantially parallel to the stringing. In a further preferred embodiment of the present invention, the ball game racket has a handle shell being arranged in the handle portion around the frame, wherein the rear dampening element is arranged below the handle shell or between the handle and the handle shell. The handle shell is preferable made of polyurethane or polyurethane foam.

The front and rear dampening elements preferably comprise different materials or are made of different materials.

According to a further preferred embodiment, the front and rear dampening elements comprise the same materials or are made of these materials.

The rear dampening element or the sheet material comprises or is made of a foam material, preferably nitrile foam, polyacrylnitrile foam, polyurethane (PUR) foam, polyvinyl chloride (PVC) foam, styrene butadiene rubber (SBR) and/or nitrile rubber or acrylnitrile butadiene rubber (NBR). The density of the rear dampening element is about 0.1 to 0.2 $g/cm^3$, preferably about 0.16 $g/m^3$, and the thickness of the rear dampening element or sheet material is preferably about 1 to 3 mm and particularly preferably about 2 mm. The hardness of the rear dampening element lies preferably in the range between 9 to 30 Shore A. Moreover, the rear dampening element is preferably particularly designed to reduce impact.

The front dampening element has preferably a length of about 6 mm and a thickness of about 4 mm and is arranged on the end of the handle portion facing the head region of the ball game racket or on the transition between the handle portion and the heart region. The front dampening element is preferably arranged on the sides of the handle portion extending substantially parallel to the stringing, wherein the element fills preferably on each of the sides an area of about 4×6 mm. Just as the rear dampening element, the front dampening element consists of a plurality of parts, of two parts or also of one part. In a further preferred embodiment of the present invention, the dampening means or the front and/or rear dampening element(s) is/are arranged so as to surround the circumference of the handle portion, i.e. including an angle of up to 360° around the longitudinal axis of the racket. The front dampening element preferably comprises or is made of a thermoplastic elastomer (TPE), thermoplastic polyurethane (TPU) and/or ethylene/vinyl acetate (EVA). The hardness of the front dampening element lies preferably in the range of between 60 and 100 Shore A and preferably at about 80 Shore A. In a further preferred embodiment, the front dampening element has a lower hardness.

It can be taken from the above description that in a preferred embodiment of the present invention the dampening device is arranged around the handle portion. For the dampening or shock or pulse absorption, however, the area of the dampening means which is arranged substantially on the sides parallel to the stringing, i.e. which is located substantially in the area of the movement normal with respect to the stringing plane, i.e. in the area of the bending vibrations and in particular in the first natural shape, is of superior importance.

Both the front dampening element and the rear dampening element allow an improved vibration and/or dampening behavior as well as an improved absorption of the striking shock. The front and/or rear dampening element(s) preferably cause(s) a decoupling, preferably a decoupling of shock and vibration between the handle and the frame. For this purpose, the materials of the front and rear dampening elements are preferably adapted to each other. In this regard, in particular a dampening means being combined of a front and rear dampening element proves to be advantageous.

In the following, the racket of the present invention is described in more detail on the basis of a preferred embodiment and with reference to the drawings in which FIG. 1 shows a partial sectional side view of a detail of a racket of the present invention;

FIG. 7 shows measuring results of a measurement of the acceleration in the handle portion of a ball game racket of the present invention comprising a dampening means;

Figure 1:
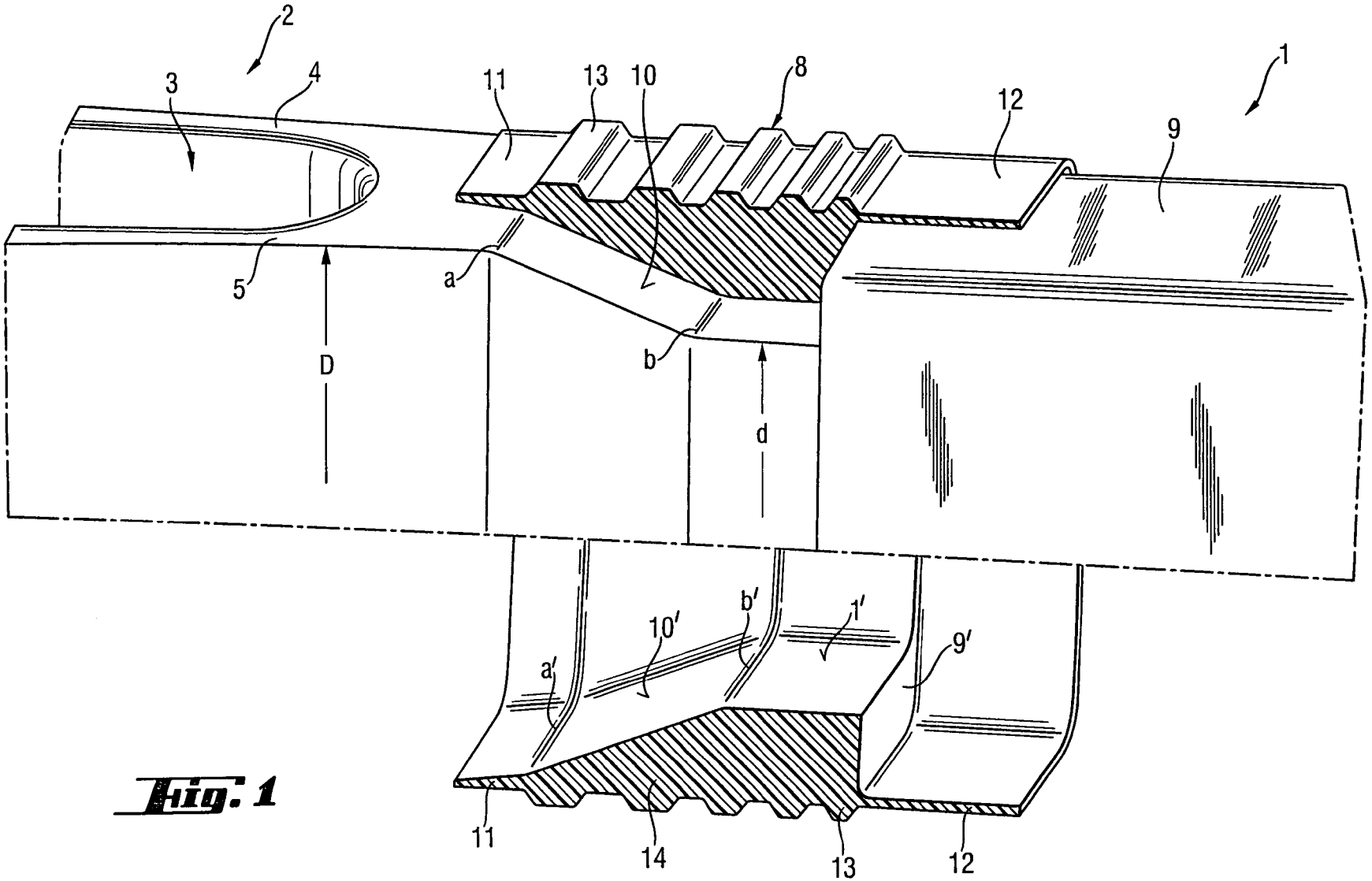

FIG. 1 shows a sectional view of a ball game racket of the present invention, in which the handle portion 1 and the heart region 2 of the racket frame can be seen. The heart region 2 of the racket is substantially the connecting region between the head region (not shown) and the handle portion 1 and comprises, for example, as shown in FIG. 1, an opening 3. This opening is not necessarily required. However, if such an opening is present, it is formed by two lateral portions 4 and 5 as well as a connecting portion or bridge (not shown) in the head region of the racket. For example for reasons of stability, a further connecting element (not shown) can be provided between the two side portions 4 and 5 of the heart region 2. In contrast to the embodiment shown in FIG. 1, the heart region 2 of the racket of the present invention can also be constructed without the opening 3, i.e. the handle portion 1 can be closed up to the head region. Also the connecting element or bridge is optional. Consequently, the heart region 2 can also be formed only of the extensions 4 and 5 of the head region, which extend towards the handle portion. Moreover, as already described above, the heart region 2 can comprise a second connecting element (not shown).

In the frame as shown, the cross-sectional shape or cross-sectional dimensions of the profile forming the racket frame are substantially constant and substantially rectangular or oval. In further preferred embodiments of the invention, the cross-sectional profile has a shape different from the shape as shown, e.g. an oval or polygonal profile or mixtures thereof, wherein a racket of the present invention can comprise different sectional profiles or cross-sectional shapes or cross-sectional dimensions in different regions.

A front dampening element 8 is arranged in the transition region between handle portion 1 and heart region 2 of the racket of the present invention. In the embodiment as shown, the handle portion 1 of the racket comprises a handle shell 9 which at least partially surrounds the handle portion 1 the racket frame. In the described preferred embodiment of the present invention, the front dampening element 8 is arranged such that it is arranged on the front end of the handle portion 1 or handle shell 9, i.e. the end facing the head region or heart region 2 of the racket, and thus forms a transition between handle portion 1 and head region or heart region 2 of the racket.

Figure 2:
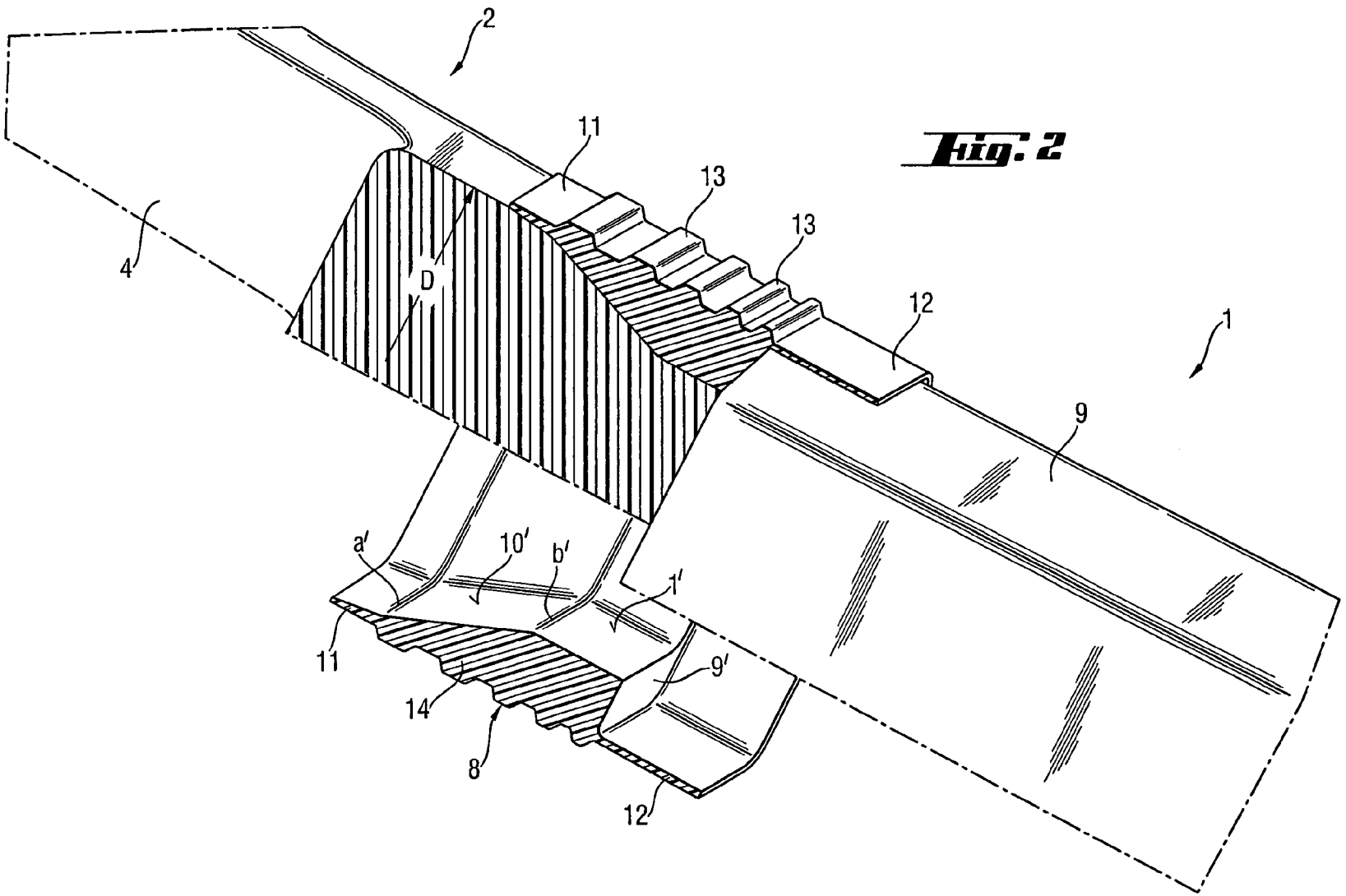
FIG. 2 shows a partial sectional side view of a detail of a racket of the present invention according to FIG. 1.
Figure 3:
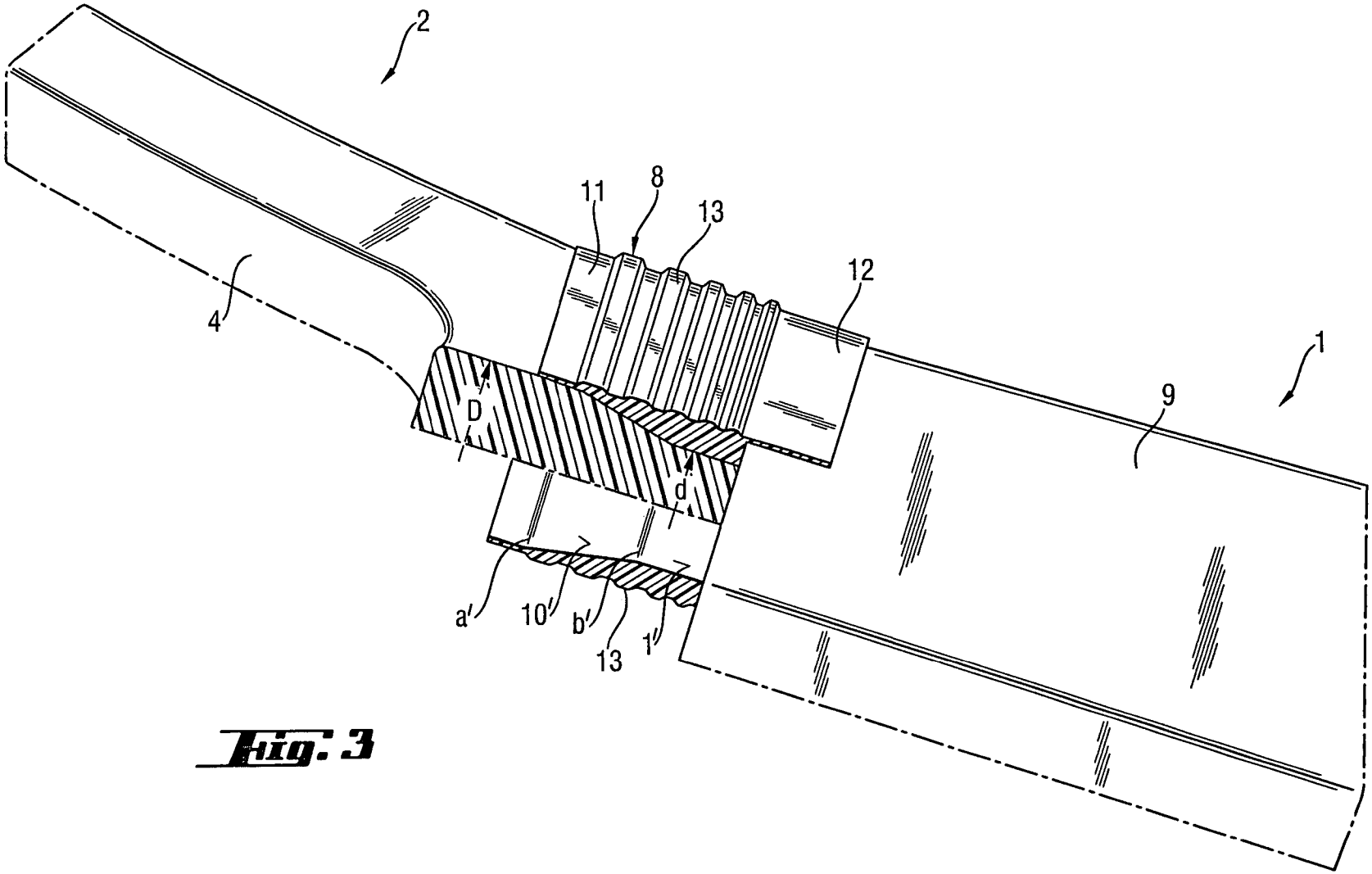
FIG. 3 shows a partial sectional front view of a detail of a racket of the present invention according to FIGS. 1 and 2.

FIGS. 1 to 3 show partial sectional side and front views of a ball game racket of the present invention, in which the front dampening element 8 is intersected in the longitudinal plane of the racket being perpendicular with respect to the stringing and in which the racket is intersected along a longitudinal plane extending parallel to the stringing. The three-dimensional representations of FIGS. 1 to 3 thus only show the "rear" or "upper" part of the front dampening element 8 (relative to the plane of the sheet) as well as the "upper" or "rear" part of the racket or frame and the handle shell 9 (also relative to the plane of the sheet).

It is clearly evident from FIGS. 1 to 3 that in the preferred embodiment as shown, the frame of the ball game racket of the present invention comprises, in the transition region between handle portion 1 and heart region 2, an enlarged cross-section in the direction perpendicular with respect to the stringing plane or a corresponding reduced cross-section in the transition between heart region 2 and handle portion 1. The cross-section changes from an area having a greater thickness D in the area of the heart region 2 to a lower thickness d in the area of the handle portion 1, wherein the change in the cross-section takes place between two transition lines a and b. In the embodiment of the present invention as shown, the reduction in the cross-section towards the handle portion 1 takes place substantially linearly between transition lines a and b, i.e. substantially in the form of an inclined plane 10. In a further preferred embodiment of the present invention, the transition region can have one or more radiuses and/or one or more planes 10. In a further preferred embodiment of the present invention, the cross-section of the frame of the ball game racket does not change in the transition region between handle portion 1 and heart region 2.

The front dampening element is preferably configured such that it contacts the outer contour of the frame in the transition region between heart region 2 and handle portion 1 and ends at the end of the handle shell 9 facing the head region of the racket. In a particularly preferred embodiment of the present invention, the front dampening element is configured such that an outer surface of the racket, which is substantially plane and parallel to the stringing, is formed from the region having the thickness D via the transition region and the region having a reduced thickness d up to the surface of the handle shell 9. The front dampening element 8 has preferably end regions 11 and 12 having a reduced thickness and surrounding respectively a partial region of the racket frame in the hart region 2 and in the handle portion 1 and a partial region of the handle shell 9.

In the preferred embodiment of the present invention as shown, the front dampening element 8 surrounds the racket frame completely. The dampening element 8 is configured such that it has a reduced cross-section towards the side surfaces, i.e. the outer surfaces of the racket frame extending perpendicular with respect to the stringing, so that a uniform transition between heart region 2 and handle portion 1 or handle shell 9 is formed.

Moreover, the front dampening element 8 preferably comprises an outer surface having ribs or webs 13. In a preferred embodiment (as shown), the ribs 13 are exclusively arranged in the region between the transition line a and the front end of the handle shell 9.

The ribs or webs 13 influence the dampening behavior of the front dampening element and, depending on the desired or required dampening properties, they have different widths and/or distances between each other. In a further preferred embodiment of the present invention, the width of and/or distance between the ribs 13 decrease(s) in the direction from the heart region 2 towards the handle portion 1.

According to the above description and the preferred embodiments of the present invention as shown, the front dampening element 8 has a portion 11 arranged at least partially in the heart region 2 of the frame, a portion 12 arranged at least partially in the handle portion 1 or handle shell 9, as well as a center portion 14 arranged therebetween, adapted to the contour of the frame and ending at the front end of the handle shell 9. The inner contour of the front dampening element 8 preferably comprises transition lines a' and b', which are arranged in the portion 14 and correspond to the transition lines a and b, as well as a plane 10' contacting the plane 10 and a surface 1' contacting the handle portion 1 of the frame, as well as a region 9' located on the handle shell 9 and extending perpendicular with respect to the stringing plane.

The different dimensions, e.g. the thicknesses D and d, the configuration of the transition region (plane 10) as well as the dimension and contour of the handle shell 9 and the distance of the front end of the handle shell 9 from the transition region between handle portion 1 and heart region 2 and thus also the dimensions of the front dampening element 8 to be selected depend on the properties and characteristics of the ball game racket which should be achieved. In a preferred embodiment of the present invention, the front dampening element has a greatest thickness of about 2 to 6 mm, preferably about 4 mm in the region 14 and a length of about 4 to 10 mm, preferably 6 mm in the region of the surface 1'.

Figure 4:
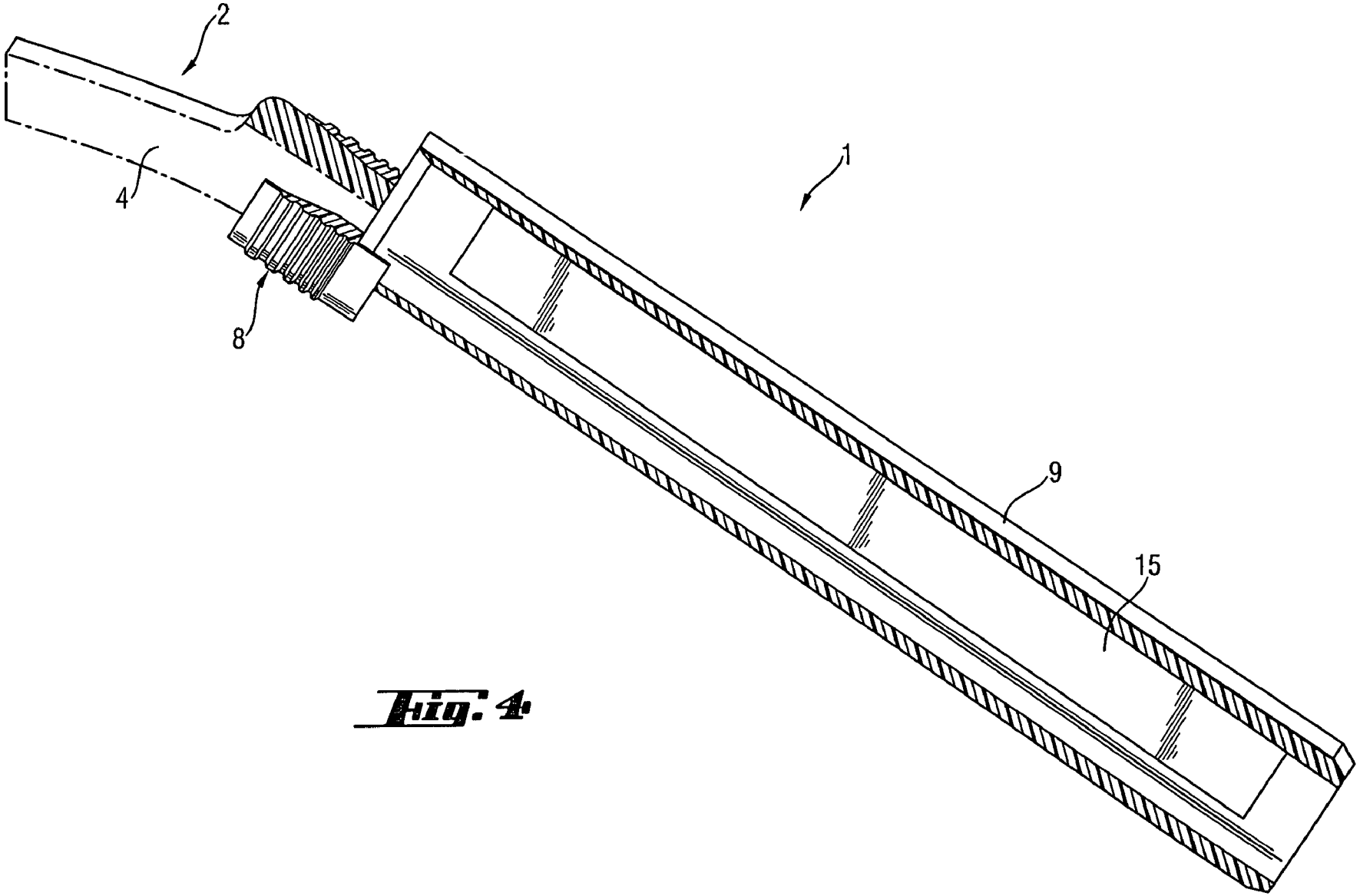
FIG. 4 shows a partial sectional view of a detail of a racket of the present invention.
Figure 5:
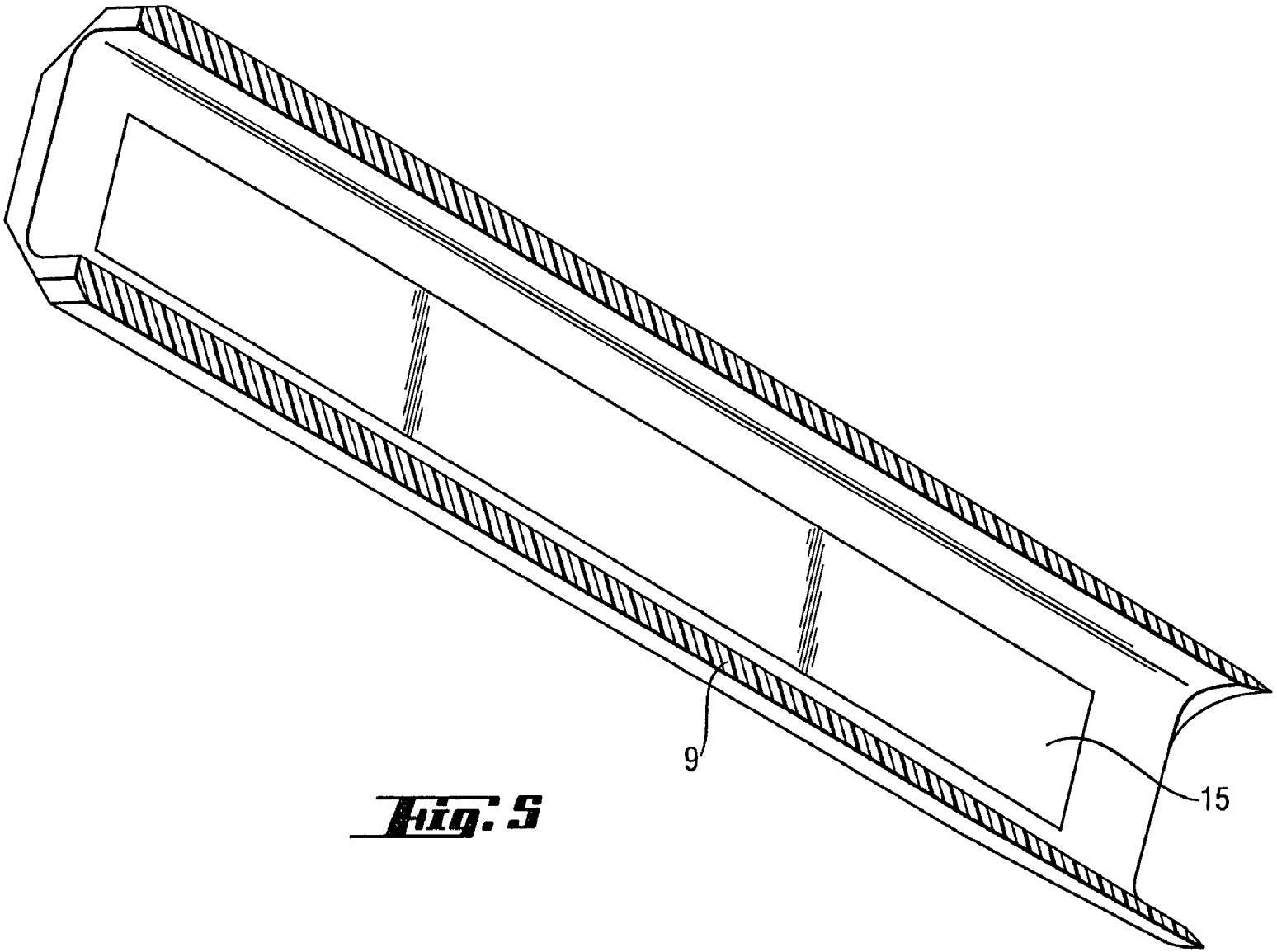
FIG. 5 shows a sectional view of a handle shell of a racket of the present invention comprising a rear dampening element.

The rear dampening element 15, which is preferably configured as a sheet material, is shown, for example, in FIGS. 4 and 5. FIG. 4 shows a partial sectional view of a detail of the racket of the present invention, wherein the frame is cut through so that a partial sectional view of handle shell 9 is exposed and a rear dampening element 15, which is arranged in the handle shell, can be seen. FIG. 5 shows a corresponding sectional view of the handle shell 9 comprising a dampening element 15. In a preferred embodiment of the present invention, the rear dampening element 15 is arranged in the handle portion 1 between the frame of the ball game racket and the handle shell 9. In a particularly preferred embodiment of the present invention, the rear dampening element is configured as a sheet material being arranged on the outer surface of the handle 1, which extends substantially parallel to the stringing, between the handle 1 and the handle shell 9 (cf. FIGS. 4 and 5). In a further embodiment of the present invention, as shown, e.g., in FIGS. 4 and 5, the sheet material is arranged in a corresponding recess or groove formed in the handle shell 9. In a further preferred embodiment of the present invention, the rear dampening element 15 surrounds the grip integrally (not shown). The rear dampening element has preferably a length of 140 to 220 mm and particularly preferably a length of about 180 mm. If the rear dampening element has the shape of a strip, this strip has preferably a width of 10 to 30 mm and particularly preferably a width of about 14 mm. The dimensions of the groove preferably correspond to the dimensions of the sheet material or the rear dampening element 15.

The rear dampening element 15 has preferably a density of about 0.16 g/cm$^3$ and/or a hardness in the range of between about 9 to 30 Shore A. The rear dampening element is moreover preferably intended for impact reduction. Furthermore, the rear dampening element has preferably a thickness in the range of between 1 to 3 mm and particularly preferably a thickness of 2 mm. Moreover, the rear dampening element preferably comprises or is made of nitrile foam, polyacrylnitrile foam, polyurethane (PUR) foam, polyvinyl chloride (PVC) foam, styrene butadiene rubber (SBR) and/or nitrile rubber or acrylnitrile butadiene rubber (NBR).

Figure 6:
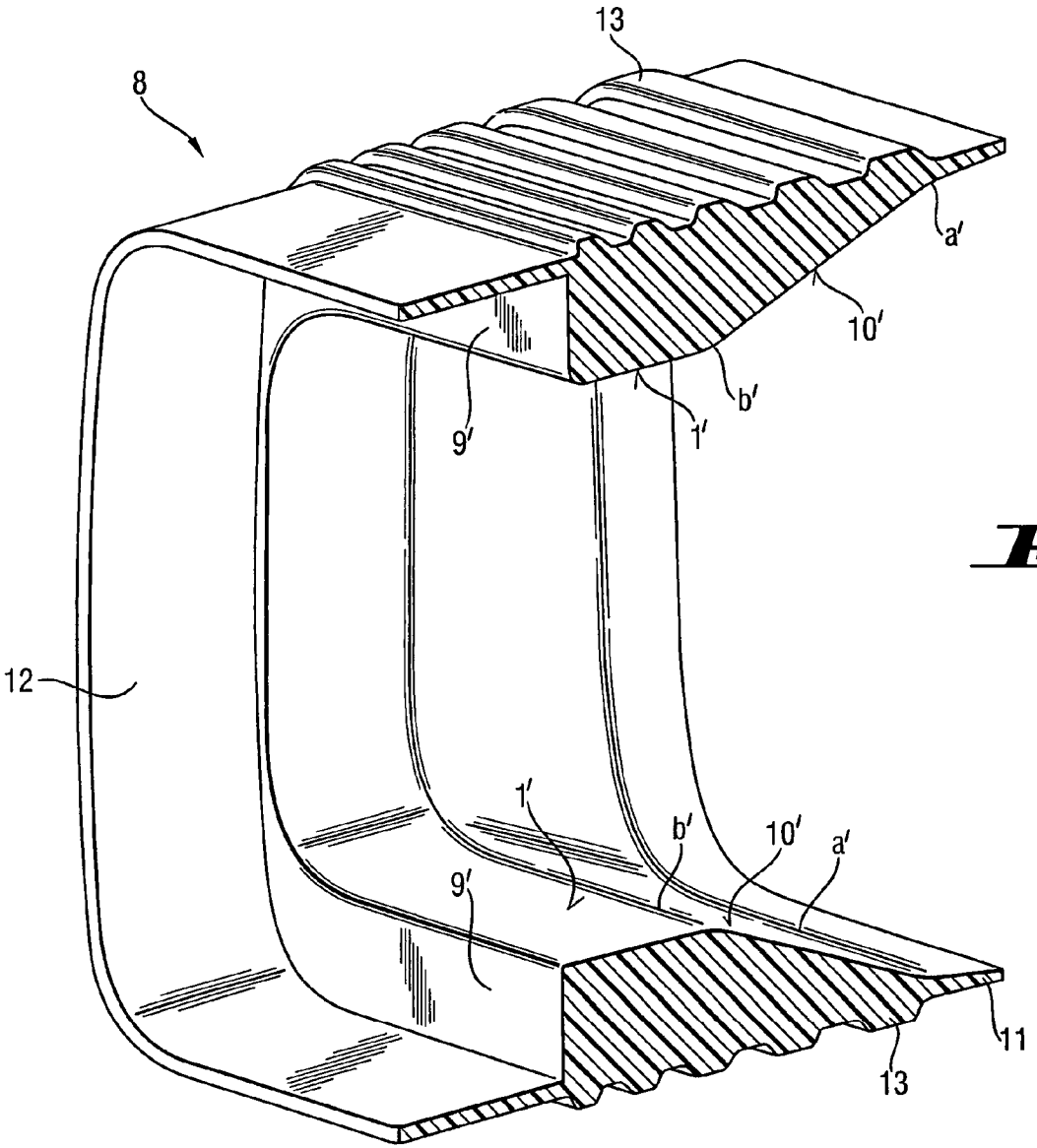
FIG. 6 shows a sectional view of a front dampening element of the present invention.
Figures 1, 1A, 1B, 1C:
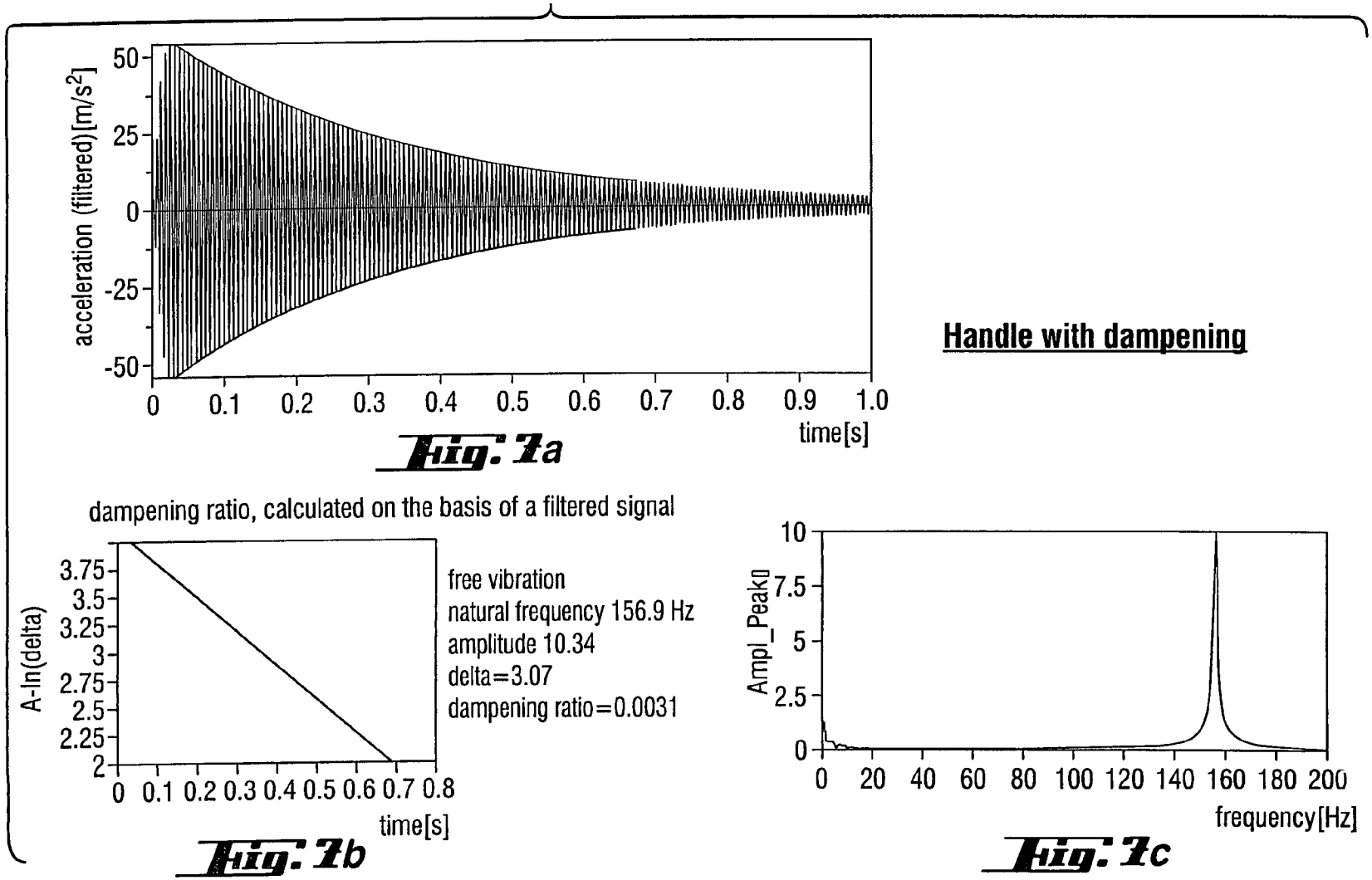

FIG. 6 shows a sectional three-dimensional view of a front dampening element 8 of the present invention in which the end regions 11 and 12 having a reduced thickness are clearly shown and which respectively surround a partial area of the racket frame in the heart region 2 and the handle portion 1 or a partial area of the handle shell 9. Furthermore, the ribs 13 as well as the corresponding increase in the rib width and the distance between the ribs are shown. In a preferred embodiment of the present invention, the ribs surround the front dampening element 8 completely. Moreover, FIG. 6 shows in accordance with FIGS. 1 to 3 the surfaces 1' and 10' contacting the racket contour, and, as already discussed, it is put forward that the corresponding surfaces can also be realized as one surface or plane, as a bent region and/or stepped region. In a particularly preferred embodiment of the front dampening element 8 of the present invention, its inner surface contacts closely the racket contour or the contour of the frame and the handle shell.

The front dampening element 8 preferably comprises or is made of a thermoplastic elastomer (TPE), thermoplastic polyurethane (TPU) and/or ethylene/vinylacetate (EVA). The front dampening element moreover preferably has a hardness in the range of about 60 to 100 Shore A and particularly preferably 80 Shore A. In further preferred embodiments of the present invention, however, also softer dampening elements can be used.

In a particularly preferred embodiment, the handle shell 9 comprises or is made of polyurethane, e.g. a polyurethane foam.

In a further preferred embodiment of the present invention, the two dampening elements are arranged such with respect to each other that they contact each other. In a further preferred embodiment of the present invention, the two dampening elements are connected with each other.

Figures 8, 8A, 8B, 8C:
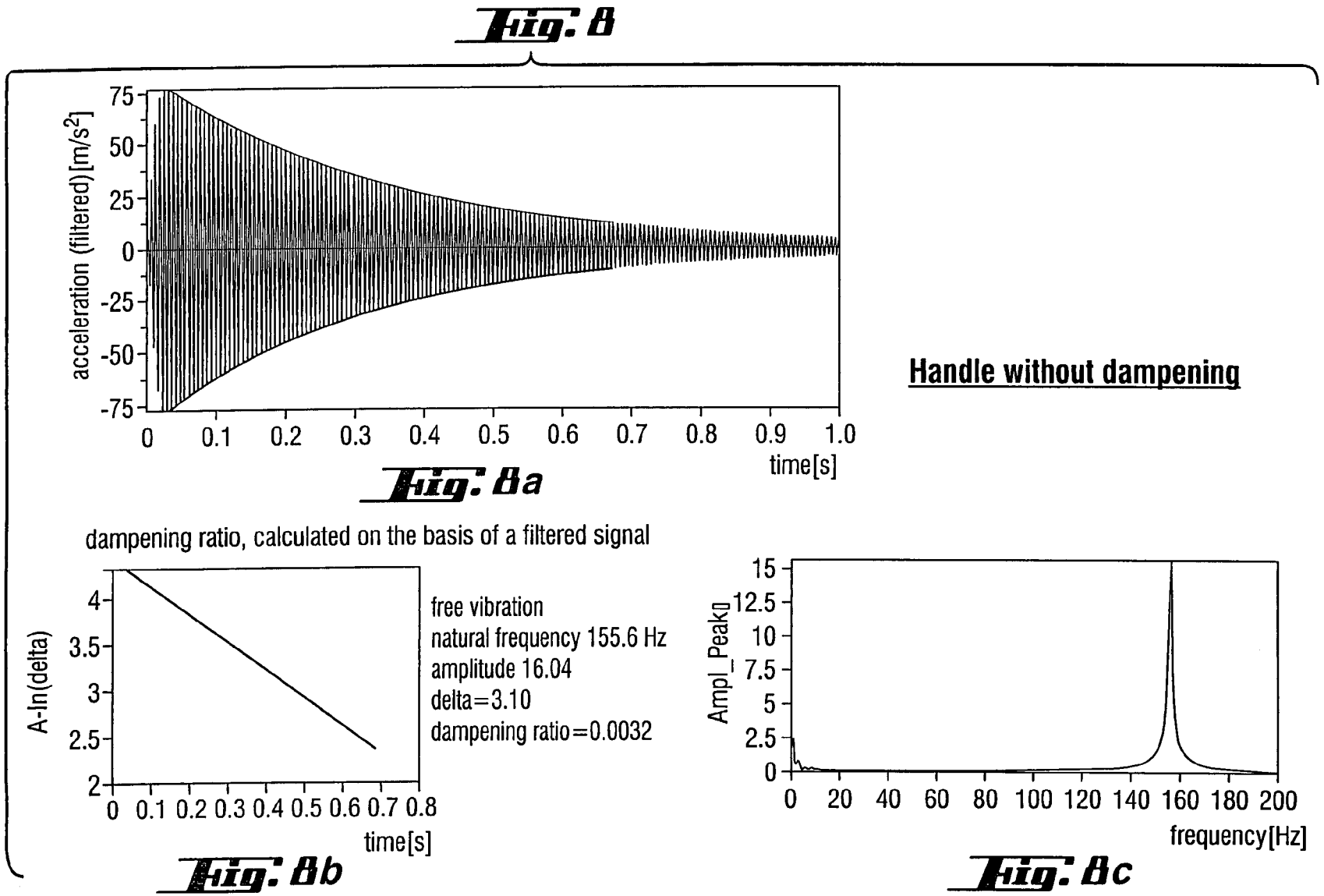
FIG. 8 shows measuring results of a measurement of the acceleration in the handle portion of a known ball game racket not comprising a dampening means of the present invention.

FIGS. 7 and 8 show the acceleration behavior of a ball game racket in the area of the handle portion, wherein FIG. 7 shows the behavior of a racket of the present invention comprising a rear dampening element, while the representation of FIG. 8 is based on a racket which is not dampened in accordance with the present invention.

The individual charts in FIGS. 7 and 8 correspond to acceleration measurements. Charts 7*a* and 8*a* show the acceleration behavior of the corresponding racket in terms of time in a so-called vibration or dampening diagram in which an acceleration is shown as a function of time. It is clearly evident that the racket of the present invention exhibits a clearly lower initial acceleration and, additionally, a faster reduction in the acceleration of the racket in terms of time. It is to be noted that the calculations were generally made with a uniform pulse or a standard energy input. It can be taken from FIGS. 7 and 8, i.e. charts 7*c* and 8*c* that the dampening of the present invention in the handle portion, i.e. by means of the rear dampening element, causes a clear reduction in the amplitude representing the acceleration peaks for the player from 16.4 to 10.34, i.e. a reduction of more than 25% and even of more than 35%. It can, i.a., be concluded that in the racket of the present invention more energy is carried away than in a racket according to the state of the art.

Charts 7*b* and 8*b* show the linearized acceleration A-In (delta) in terms of time. The charts show a delta=3,07 for a racket of the present invention and a delta=3.10 for a racket according to the state of the art. The dampening ratio is 0.0031 with dampening and 0.0032 without dampening.

Charts 7*c* and 8*c* show the natural or characteristic frequency of the respective racket as an amplitude peak vis-a-vis the frequency. It is clearly evident that the natural or characteristic frequency of the racket of FIG. 7 is 156.9 Hz and that of the racket of FIG. 8 is 155.6 Hz. The maximum amplitude of the racket of FIG. 7 is 10.34 while that of the racket of FIG. 8 is 16.04. The amplitudes do not have a unit because the calculations were generally made with a uniform pulse or a standard energy input, as described above.

Figures 9, 9A, 9B, 9C:
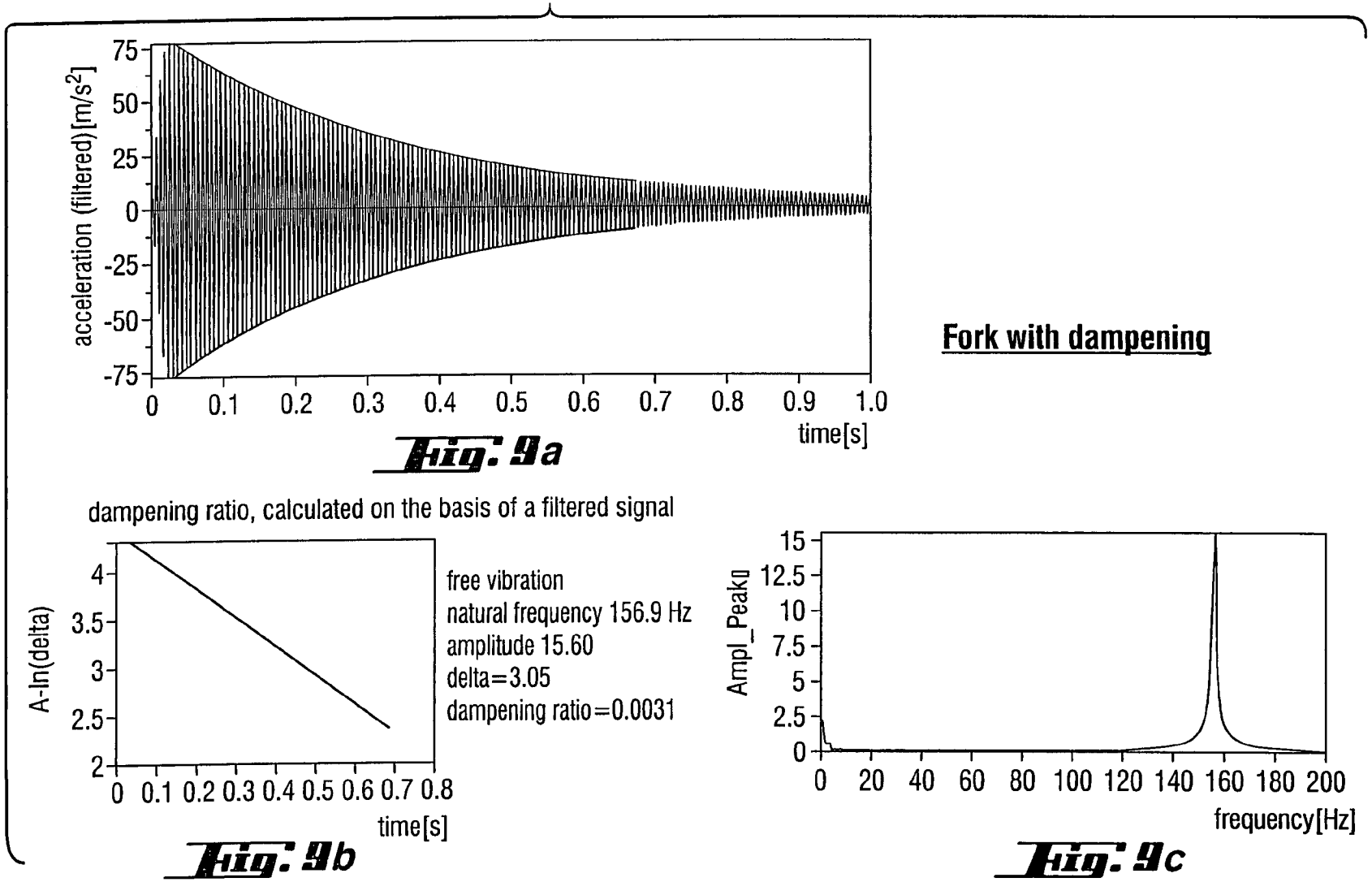
FIG. 9 shows measuring results of a measurement of the acceleration in the heart region of a ball game racket of the present invention comprising a dampening means.
Figures 10, 10A, 10B, 10C:
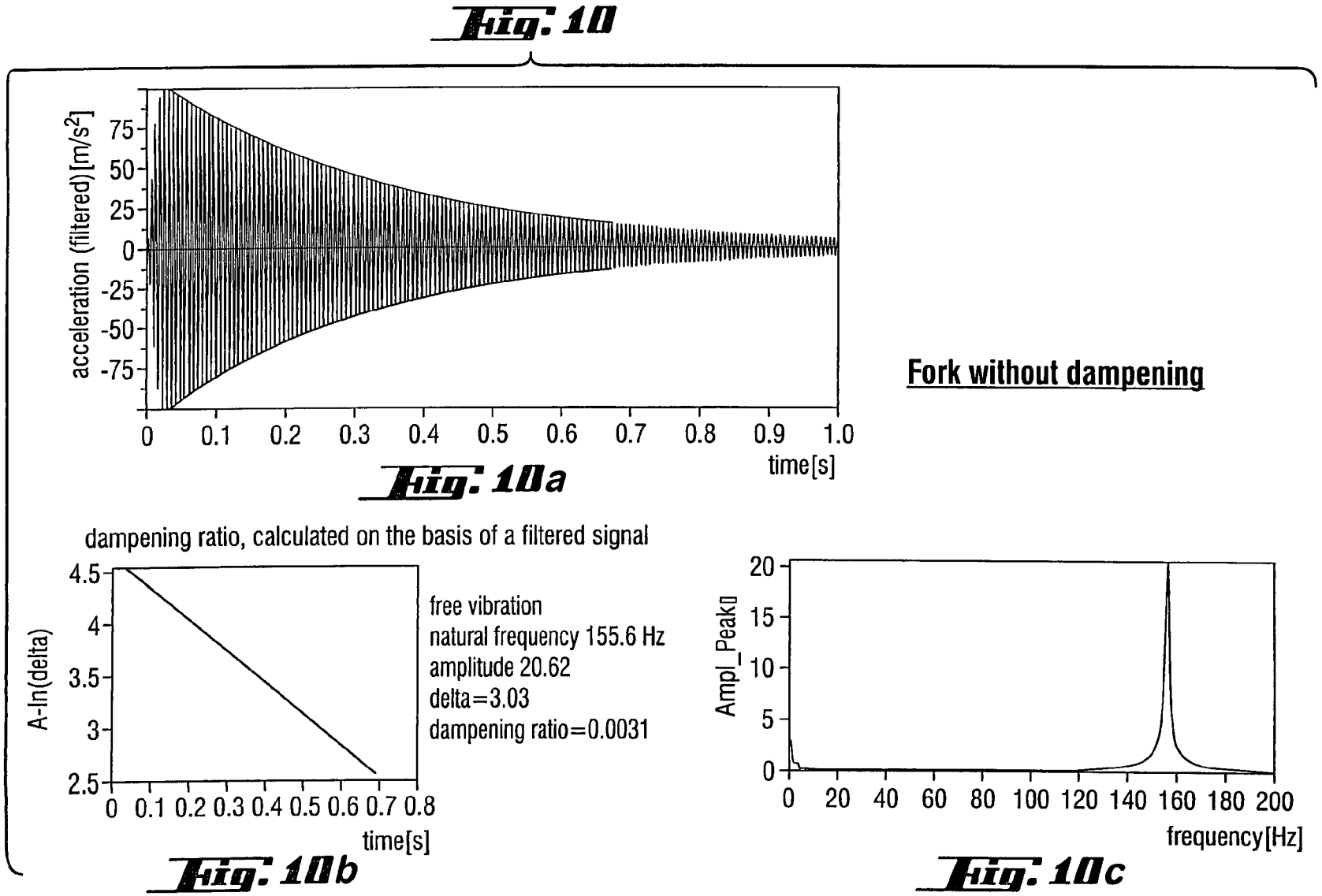
FIG. 10 shows measuring results of a measurement of the acceleration in the heart region of a known ball game racket not comprising a dampening means of the present invention.

Also in a racket of the present invention having a front dampening element, i.e. in the front handle portion or in the region of the fork or the transition between heart region and handle portion, the embodiment of the present invention causes, according to the measurements shown in FIGS. 9 and 10, a reduction in the amplitude from 20.62 to 15.60, i.e. of more than 25%. The reduction in the acceleration of the racket is accordingly, as discussed with respect to FIGS. 7 and 8.

Charts 9*b* and 10*b* show the linearized acceleration A-In (delta) in terms of time. The charts show a delta=3.05 for a racket of the present invention and a delta=3.03 for a racket according to the state of the art. The dampening ratio is 0.0031 with dampening and 0.0031 without dampening.

Charts 9*c* and 10*c* show the natural or characteristic frequency of the respective racket as an amplitude peak vis-a-vis the frequency. It is clearly evident that the natural or characteristic frequency of the racket of the present invention according to FIG. 9 is 156.9 Hz and that of the racket of FIG. 10 is 155.6 Hz. The maximum amplitude of the racket of FIG. 9 is 15.60 while that of the racket of FIG. 10 is 20.62.

Figure 11:
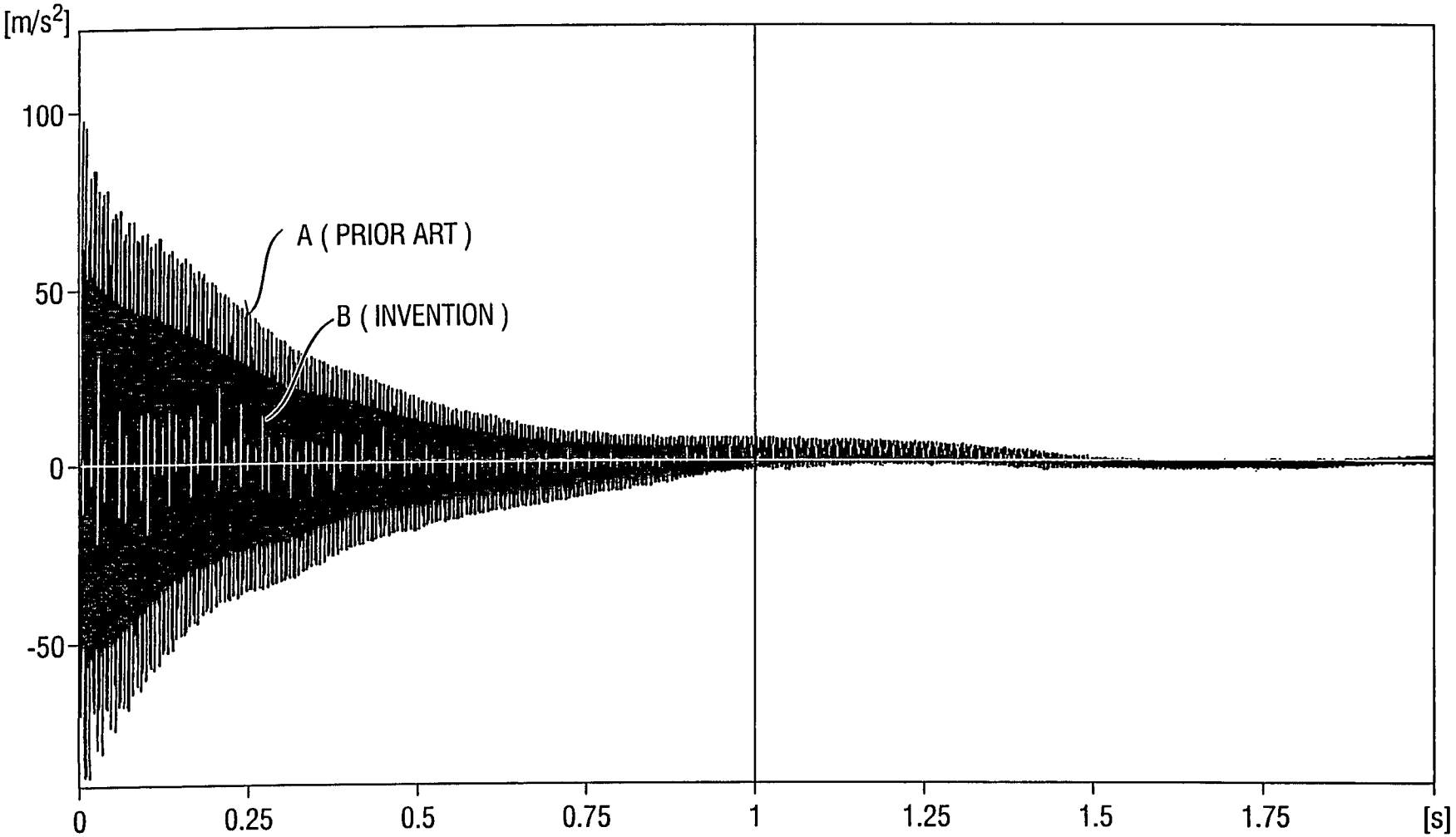
FIG. 11 shows a graphical representation of the overlapping of the measurement curves with and without dampening in the region of the handle.

FIG. 11 shows a vibration or dampening diagram in which, just like in charts 7*a*, 8*a*, 9*a* and 10*a*, an acceleration is shown as a function of time. This means that the diagram of FIG. 11 shows the vibration behavior of a racket of the present invention comprising a rear dampening element and that of a known racket without a dampening element. The "outer", gray curve corresponds to the known racket, while the "inner", black curve corresponds to the racket of the present invention. The effect of the dampening element of the present invention is clearly evident. The use of a dampening element of the present invention causes a reduction in the amplitude as well as a faster reduction in the acceleration in terms of time, so that considerably improved use properties can be achieved. The player is thus offered the advantages discussed above.

FIGS. 7 and 8 and/or 9 and 10 as well as 11 clearly show the effect of the two dampening elements in the handle and in front of the handle or at the fork or in the transition between the handle portion and heart region. The dampening of the present invention causes an improved absorption of the impact shock and furthermore leads to improved playability characteristics, so that the player is allowed to play in a safer and simpler manner and the risk of injuries is reduced. A racket having both front and rear dampening elements has particularly advantageous properties.

All known materials for tennis, squash, badminton or other rackets for ball games are appropriate materials for the ball game racket of the present invention. In particular, rackets of the present invention can be made of wood, metal, metal alloys, plastics, carbon fiber composite materials, fiber materials, composite materials, and combinations thereof.

Moreover, the present invention provides a process for producing a ball game racket having a frame comprising a handle portion and in particular a ball game racket corresponding to the preferred embodiments described above.

A preferred process comprises the following steps. First, several layers of a material are stacked in order to form the frame of the racket, wherein in the handle portion of the racket at least one layer of a material exhibiting dampening properties is placed between and/or around the material layers in order to form the rear dampening element. The thus formed multi-layer structure is then placed in a mold and subsequently molded and hardened. The ball game racket is then removed from the mold. Subsequently, the front dampening element is arranged on the racket. Moreover, in a further step, the handle shell is arranged in the handle portion of the racket.

In a further preferred process of the present invention, first the frame is produced by stacking one or more layers of a material, placing the latter in a mold and then molding and hardening the structure. After production of the frame, the front dampening element, the rear dampening element and/or the handle shell is/are arranged in the handle portion of the frame.

The dampening means or dampening elements can be attached to the frame in different manners. The dampening elements can be configured such that they have to be expanded for being applied to the frame, and after application they are held on the frame by inner forces due to the elastic deformation. This method of attachment is preferably used in case of the above embodiment in which the dampening elements consist of one part and surround the racket.

Moreover, the dampening elements can be bonded or glued to the frame or attached thereto by means of mechanical fastening elements. In a further preferred embodiment of the invention, the front dampening element and/or rear dampening element is connected with or attached to the handle shell. The front and rear dampening elements do not have to be attached in the same manner. In a further preferred embodiment of the present invention, the front dampening element and/or rear dampening element is/are attached to both the frame of the ball game racket and the handle shell. In a further preferred attachment of the dampening elements, the latter are only held by the handle shell and/or a handle or grip tape wrapped around the handle portion.

In contrast to rackets known from the state of the art, a ball game racket of the present invention guarantees an improved vibration and/or dampening behavior, in particular in case of bending vibrations and, moreover, in particular in case of their first natural form. A racket of the present invention thus allows an improved absorption of the impact shock and exhibits improved playability characteristics. The player is thus allowed to play in a safer and simpler manner, and also the risk of injuries is reduced.

Moreover, a ball game racket comprising the dampening device of the present invention surprisingly has a particularly advantageous dampening characteristic being pleasant to the player, can be handled very well and is vibration-preventing. Moreover, the dampening device has a simple construction so that the production costs are low. The dampening device can be mounted in a simple manner.

The invention claimed is:

1. A ball game racket comprising a frame having a head region for receiving a stringing, a heart region and a handle portion including a handle shell for holding the ball game racket, and a dampening means provided in the handle portion and having at least one front dampening element and at least one rear dampening element, wherein in the handle portion the frame consists of a multi-layer structure and the rear dampening element forms at least one layer of the multi-layer structure, and wherein the at least one front dampening element is formed at the end of the handle portion facing the head region of the ball game racket so that in the area of the transition between the heart region and the handle portion it contacts the outer contour of the frame and ends at the end of the handle shell facing the head region of the racket.

2. The ball game racket of claim 1, wherein the rear dampening element is configured as a sheet material.

3. The ball game racket of claim 1, wherein the dampening means has one front dampening element and one rear dampening element.

4. The ball game racket according to claim 1 wherein the frame is formed of plurality of layers of a carbon fiber composite material and the sheet material of the rear dampening means is placed between two or more layers of the carbon fiber composite material.

5. The ball game racket according to claim 1, wherein the sheet material comprises a foamed material.

6. The ball game racket according to claim 1, wherein the sheet material comprises nitrile foam, polyacrylnitrile foam, polyurethane (PUR) foam, polyvinyl chloride (PVC) foam, styrene butadiene rubber (SBR) and/or nitrile rubber or acrylnitrile butadiene rubber (NBR).

7. The ball game racket according to claim 1, wherein the sheet material is in the form of a strip of at least 10 mm×at least 140 mm.

8. The ball game racket according to claim 1, wherein the at least one front dampening element comprises a foamed material.

9. The ball game racket according to claim 1, wherein the at least one front dampening element comprises a thermoplastic elastomer (TPE), thermoplastic polyurethane (TPU) and/or ethylene/vinylacetate (EVA).

10. The ball game racket according to claim 1, wherein the at least one front dampening element has dimensions of 2–6 mm×4–10 mm.

11. The ball game racket according to claim 1, wherein the rear dampening element has at least partially a density of about 0.16 g/cm$^3$.

12. The ball game racket according to claim 1, wherein the front dampening element has at least partially a hardness of about 60 to 100 Shore A and the rear dampening element of about 9 to 30 Shore A.

13. The ball game racket according to claim 1, wherein a handle shell is arranged in the handle portion.

14. The ball racket according to claim 13, wherein the handle shell is made of polyurethane.

15. The ball game racket according to claim 1, wherein the sheet material and/or the at least one front dampening element is/are arranged on the handle surface(s) extending parallel to the stringing.

16. The ball game racket according to claim 1, wherein the sheet material and/or the at least one front dampening element surround(s) the handle.

17. The ball game racket according to claim 1, wherein the at least one front dampening element has dimensions of about 4×6 mm.

18. A ball game racket comprising a frame, which forms a head region for receiving a stringing and a handle portion for holding the ball game racket, and a dampening means provided in the handle portion, wherein in the handle portion the frame has a multi-layer structure and the dampening means comprises a rear dampening element configured as a sheet material and forming at least one layer of the multi-layer structure, wherein a handle shell is arranged in the handle portion and sheet material is arranged below the handle shell.

* * * * *